United States Patent [19]

Carlson

[11] Patent Number: 5,068,901

[45] Date of Patent: Nov. 26, 1991

[54] DUAL OUTLET PASSAGE HEARING AID TRANSDUCER

[75] Inventor: Elmer V. Carlson, Prospect Heights, Ill.

[73] Assignee: Knowles Electronics, Inc., Itasca, Ill.

[21] Appl. No.: 517,569

[22] Filed: May 1, 1990

[51] Int. Cl.[5] ..... H04R 25/00

[52] U.S. Cl. ..... 381/68.6; 381/69

[58] Field of Search ..... 381/68.6, 69, 68, 159, 381/187, 68.2, 68.7, 69.1, 69.2; 181/129, 130, 135

[56] References Cited

U.S. PATENT DOCUMENTS

| | | | |
|---|---|---|---|
| 3,013,127 | 12/1961 | Christensen et al. . | |
| 3,111,563 | 11/1963 | Carlson . | |
| 3,177,412 | 4/1965 | Carlson . | |
| 3,193,048 | 7/1965 | Kohler . | |
| 3,536,861 | 10/1970 | Dunlavy . | |
| 3,560,667 | 2/1971 | Carlson . | |
| 3,763,333 | 10/1973 | Lichowsky | 381/68 |
| 3,819,860 | 6/1974 | Miller | 381/187 |
| 4,440,982 | 4/1984 | Kaanders et al. | 381/69 |
| 4,450,930 | 5/1984 | Killion . | |
| 4,800,982 | 1/1989 | Carlson | 381/68.6 |
| 4,815,560 | 3/1989 | Madaffari | 381/68.6 |
| 4,867,267 | 9/1989 | Carlson | 181/135 |

*Primary Examiner*—Jin F. Ng
*Assistant Examiner*—Jason Chan
*Attorney, Agent, or Firm*—Kinzer, Plyer, Dorn, McEachran & Jambor

[57] ABSTRACT

An improved high-frequency characteristic is achieved, in an otherwise conventional hearing aid receiver transducer, by connecting each of the acoustic chambers on the two sides of the receiver diaphragm, in the receiver housing, directly through an outlet port and a sound transmission tube coupled into the ear canal of the hearing aid user; phase reversals due to resonances in the receiving acoustic chambers and tubes produce a high pass band in the output of the receiver as applied to the user's ear. An acoustically transparent contamination stop prevents contaminants (e.g. cerumen) from reaching the transducer motor but does not interfere with acoustic performance.

14 Claims, 2 Drawing Sheets

Fig. 1.
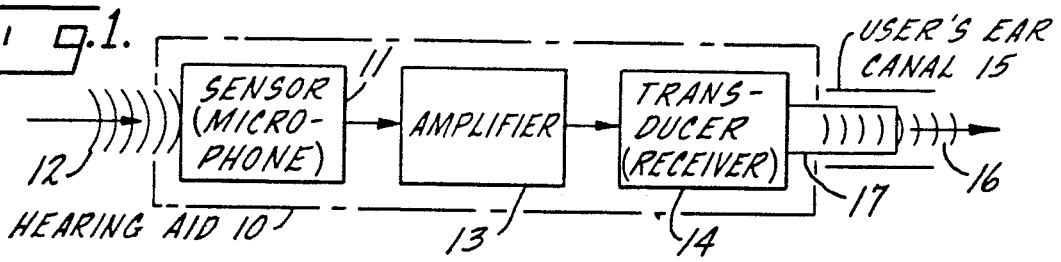
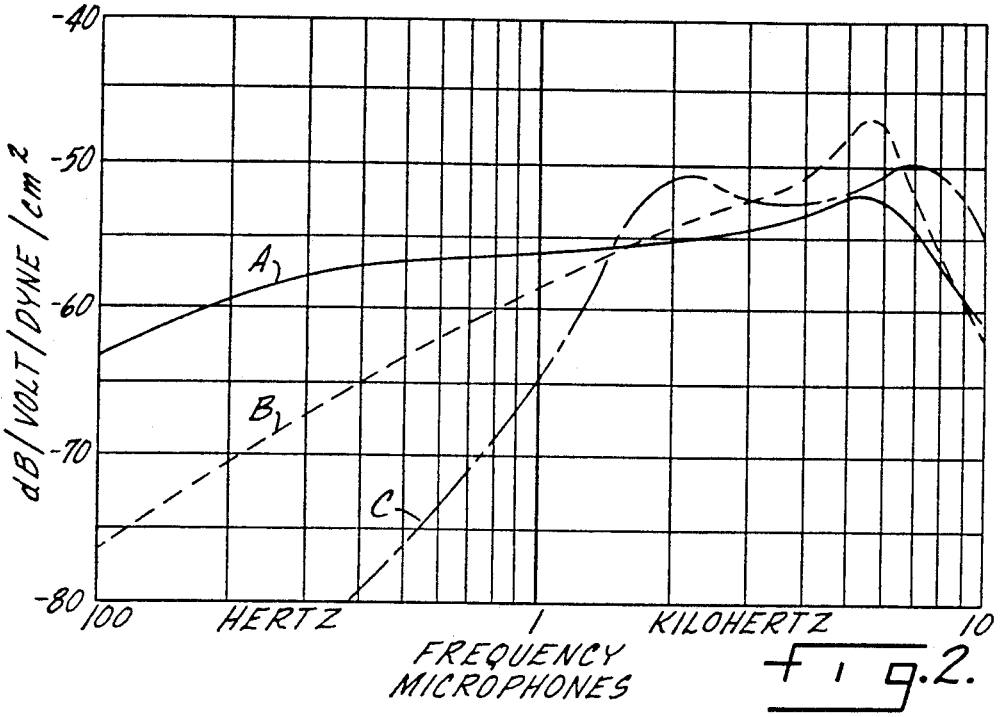
Fig. 2.
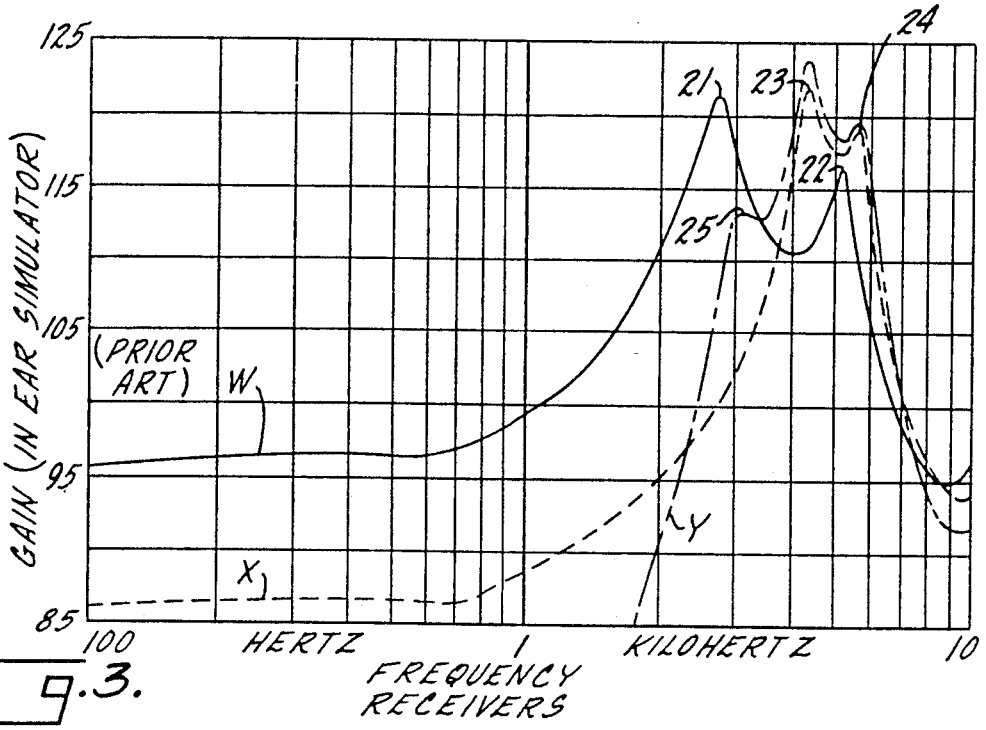
Fig. 3.

DUAL OUTLET PASSAGE HEARING AID TRANSDUCER

BACKGROUND OF THE INVENTION

A hearing aid usually utilizes the basic components shown in the device 10 in FIG. 1 of the drawings. A microphone 11 senses ambient sound 12 and develops an electrical signal representative of that sound. The electrical signal is amplified, in an amplifier 13, and then used to drive a sound reproducer or transducer 14, frequently called a receiver. The receiver 14 may be coupled to the ear canal 15 of the user of the hearing aid by a sound transmission tube 17, supplying a sonic signal 16 to the hearing impaired person using the aid 10. The entire device 10, including components not shown in FIG. 1 (e.g., an on-off-switch, a battery, a volume control, etc.) is often small enough to fit in the user's ear, though other packaging arrangements have been and are used.

The hearing losses of a major portion of the hearing-impaired population occur primarily in the higher frequency end of the audio spectrum. These people frequently have normal or near normal hearing at the lower and middle frequencies. Thus, hearing aids tend to be designed to emphasize amplification of the higher audio frequencies. They may provide little if any amplification at the lower end of the audio spectrum.

One popular approach is to provide a vent or channel in the ear mold or through the hearing aid itself, if it is of the in-the-ear variety. That channel is apportioned so that low frequency sounds can enter the ear directly, without amplification, while high frequency sounds that are amplified are retained within the ear by frequency-discriminating characteristics of this vent. These effects may be reinforced by the design of amplifier 13 and microphone 11. Especially designed microphones are produced for this purpose, which are most sensitive at the higher frequencies; see curve A in FIG. 2.

Historically, little if any means have been found to effectuate use of the frequency characteristics of the receiver (earphone) itself to aid in this frequency selectivity. There have been older and larger versions of receivers made and sold that mimic the method used to obtain the frequency characteristic in microphones of the type indicated in curves B and C in FIG. 2. This may be accomplished in a microphone by providing a vent or tube leading from one side of the diaphragm to the other, thus allowing the sound pressure to equalize at low frequencies. There are several difficulties with this approach in the modern, more miniaturized receiver; a major problem has been to find enough space for an acoustically adequate vent. Also, probably because of the way a receiver is coupled to the ear cavity, there is a considerable loss in sensitivity using this approach.

While there is no consensus on the matter, one school of thought believes that a high frequency pass band of about an octave starting at about 3000 Hz (2500 to 3500 Hz) will be beneficial.

A conventional hearing aid receiver presently consists of an electromagnetic motor mechanism which operates a diaphragm. The air displaced by this diaphragm, on one side, is channeled through a tube into the ear canal, creating the desired sound. The air displaced on the other side is usually compacted in the volume enclosed by the receiver housing. When connected to an occluded (unvented) ear canal or to a test chamber, usually known as a coupler, this mechanism produces a frequency characteristic of the type shown as curve W in FIG. 3. The principle components controlling the frequency of the initial resonance peak 21 are the mechanical system of the motor and the channel or tube leading the sound from the diaphragm into the ear (receiver 14 and tube 17 in FIG. 1). The second resonance 22 of curve W is controlled by the necessary volume of air within the receiver that collects the sound off of the diaphragm, the channel or tube that conducts this sound to the ear canal, and the remaining portion of the ear canal.

SUMMARY OF THE INVENTION

It is a principal object of the present invention to provide a new and improved hearing aid receiver transducer which affords a desirable high frequency band pass characteristic in a particularly effective manner without sacrifice of sensitivity.

Another object of the invention is to provide a new and improved hearing aid receiver transducer that emphasizes the higher part of the audio spectrum needed for hearing comprehension without substantial cost increase and with little or no loss of dependability, operating life, or miniaturization.

Accordingly, the invention relates to a receiver transducer for a hearing aid of the kind comprising a main housing insertable into the ear of the hearing aid user; the receiver transducer comprises a receiver housing mounted within the main housing in spaced relation to a sound outlet wall of the main housing that faces into the ear canal of a hearing aid user. Diaphragm means, mounted within the receiver housing, define first and second acoustic chambers in the receiver housing, and an electromagnetic motor, mounted in the receiver housing, is mechanically connected to the diaphragm to move the diaphragm, at frequencies within a given audio range, in accordance with an electric signal applied to the motor. First and second outlet ports are provided, through the receiver housing, one for each chamber, and first and second elongated sound transmission tubes are employed, one for each outlet port, each tube connecting its outlet port through the sound outlet wall of the main housing into the user's ear canal independently of the other tube.

BRIEF DESCRIPTION OF THE DRAWINGS

FIG. 1 is a block diagram of principal components of a hearing aid, and is illustrative of the prior art as well as the environment for the present invention;

FIG. 2 illustrates microphone operating characteristics;

FIG. 3 illustrates receiver transducer operating characteristics;

Figure 4:
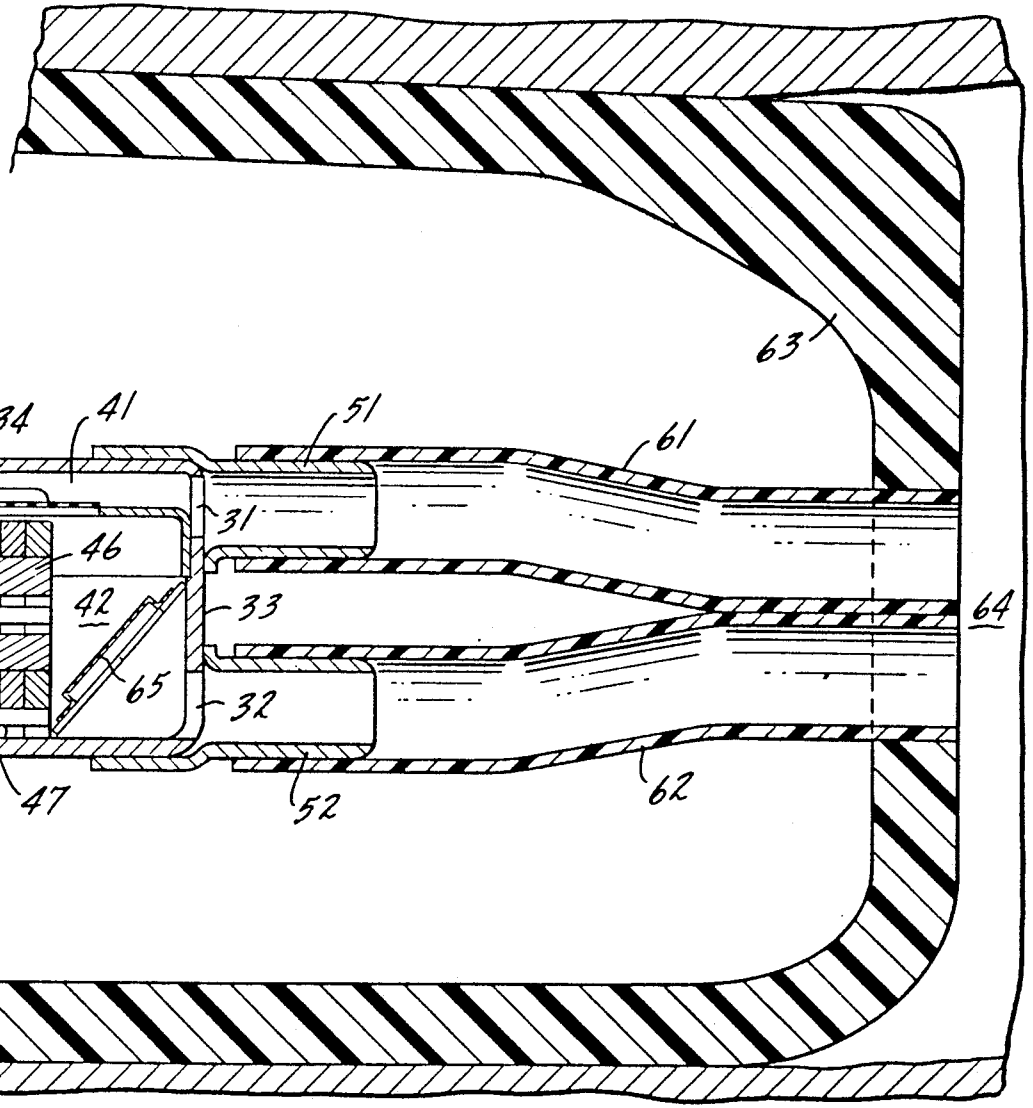
FIG. 4 is a sectional elevation view, on an enlarged scale, of a hearing aid receiver transducer constructed in accordance with one embodiment of the present invention.

To achieve an extended high frequency response in a hearing aid receiver transducer, such as receiver 14 referred to above, conventional procedure would be to raise the frequency of the initial resonance, 21 in FIG. 3, to the middle of a pass band of about 3.3 to 5.5 kilo hertz. Such an endeavor produces an operating characteristic like curve X in FIG. 3 with a sharp resonance 23, a slightly displaced second resonance 24,and a rather narrow pass band. Adding acoustic damping to widen this pass band decreases the sensitivity of the transducer. Curve X of FIG. 3 illustrates the effect of raising the resonant frequency on the smallest available hearing aid receiver, which already has the highest resonant frequency of currently available commercial devices. To damp this resonance would mean a large loss in sensitivity and little significant improvement in the differential between the high frequency and low frequency sensitivities.

By adding a second channel or tube, from the air volume on the second side of the receiver diaphragm into the ear canal of the hearing aid user,,however, much of the desired high frequency emphasis can be achieved without loss of sensitivity. This is illustrated by curve Y in FIG. 3.

With dual coupling tubes direct from opposite sides of a hearing aid receiver diaphragm to the users ear canal, as described hereinafter, several advantages are obtained. First, at the lower frequencies a cancelling effect is achieved. That is, while one side of the receiver diaphragm is creating a positive pressure in the ear canal, the other side of the same diaphragm is creating a negative pressure in the user's ear canal. This substantially reduces the net low frequency sound pressure generated in the ear canal.

Second, by adjusting the dimensions of the second tube from the receiver to the user's ear canal, it can be made to introduce a third resonance, point 25 on curve Y in FIG. 3, which if placed slightly lower in frequency than resonance 23 effectively broadens the pass band of the receiver. Thus, the resonances 23–25 produce a band pass filter action approximating the desired effect; the pass band of the new approach, curve Y in FIG. 3, is substantially broader than with the more conventional system of curve X.

Third, mechanical adjustments in the magnetic motor of the receiver to achieve the desired higher resonant frequency will cause it to have a higher mechanical impedance, to such an extent that it is not appreciably affected by interaction with the acoustic parameters of the two acoustic channels. Because of the phase reversal that occurs in that component of the signal at resonance 25, in the region between resonances 25 and 24 the resonant gains are additive, mutually increasing sensitivity in that region. A similar interaction occurs between resonances 24 and 23.

FIG. 4 is a sectional view of a receiver transducer 30 constituting one embodiment of a hearing aid receiver constructed in accordance with the invention. Transducer 30 includes a housing 29; there are two outlet ports 31 and 32 in one end wall 33 of the housing. Receiver 30 is mounted in a main hearing aid or ear mold housing, of which only one wall 63 appears in FIG. 4. A diaphragm 34 extends across the interior of housing 29, dividing it into a first acoustic chamber 41 and a larger second acoustic chamber 42. An electromagnetic motor 40, mounted in chamber 42 in housing 29, has its armature 43 connected to diaphragm 34 by a drive pin 44. Motor 40 may include a coil 45, permanent magnets 46, and a yoke 47. Electrical terminals 48 provide a means to apply driving signals to coil 45 from a hearing aid amplifier; see amplifier 13 in FIG. 1. The first output port 31 is connected to a short tube 51 that is really a part of housing 29; a similar short outlet tube 52 serves the other port 32. Two longer conduits, the elongated sound transmission tubes 61 and 62, are connected from the housing tubes 51 and 52, respectively, through the sound outlet wall 63 of the main hearing aid housing into the ear canal 64 of the hearing aid user. The illustrated mechanical couplings for tubes 61 and 62, especially the short tubes 51 and 52, will be recognized as exemplary only and other arrangements maybe utilized.

Figure 5:
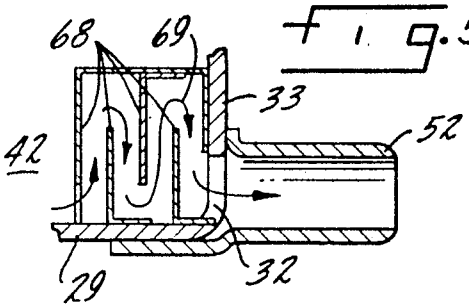
FIG. 5 is a detail view of a different form of contaminant stop for the hearing aid receiver.

Within receiver housing 29, between the second sound outlet port 32 and chamber 42, there is a contamination stop 65. This contamination stop may be of virtually any construction so long as it is acoustically transparent but prevents contaminants from reaching the motor 40 in chamber 42. Thus, contamination stop 65 may comprise a very thin plastic film diaphragm, such as a film of polyurethane of about 0.0005 inch thickness. Stop 65 may also constitute a grid or screen, of plastic or a corrosion resistant metal, having small apertures so as to afford adequate protection for motor 40 against most solid contaminants, particularly ear wax, without interfering with acoustic performance. The contamination stop may also comprise a series of barriers 68 leaving a clear but tortuous path 69 between port 32 to chamber 42 to stop contaminants while allowing unimpeded flow of acoustic waves therebetween; see FIG. 5.

In operation, electrical signals applied to coil 45 of motor 40 cause the motor to drive diaphragm 34. This moves the air in chamber 41 in and out, through port 31 and tubes 51 and 61, into the ear canal 64, in conventional manner. The air in the second chamber 42 in housing 29 also responds to the operation of diaphragm 34; it moves from the chamber through contamination stop 65, port 32, and tubes 52 and 62 into ear canal 64, at low frequencies, since pressure in chamber 41 increases when pressure in chamber 42 decreases, and vice versa. Since there are equal amounts of air displaced on opposite sides of the diaphragm, at low frequencies the two outputs into ear canal 64, through tubes 61 and 62, tend to cancel each other. That is the reason for virtually no amplification at low frequencies in curve Y, FIG. 3.

At higher frequencies, however, the operation of the dual-outlet receiver transducer 30 is quite different. As the sound frequency increases beyond the acoustical resonance frequency of the second outlet for receiver 30, specifically chamber 42, port 32 and its outlet tube 52, and sound transmission tube 62, a phase shift of 180° occurs in the sonic energy traversing this part of the device. As a consequence, the sound outputs from the two tubes 61 and 62 into ear canal 64 become effectively additive, instead of cancelling each other as in low frequency operation. When the resonant frequency of the first chamber 41 and its outlet 31, 51, 61 is reached, another phase reversal occurs and the outputs into ear canal 64 are again out of phase. This determines the upper end of the pass band for receiver 30; see FIG. 3. The preferred range for the first resonance frequency (elements 31, 41, 51, 61) is approximately five to seven kHz. For the second resonance the preferred range is approximately 2.5 to 3.5 kHz.

As will be apparent from the foregoing description, effective operation of receiver 30 to achieve the desired operating characteristic (curve Y in FIG. 3) requires that the second outlet port 32 be directly acoustically coupled to the second chamber 42 in receiver housing 29. But the addition of the second port to the receiver increases the hazards to the magnetic motor 40, which has parts with close mechanical clearances. If material is allowed to enter the chamber 42 which contains motor 40 it will interfere with motion of these parts and performance will be impaired. Thus, the contamination stop 65 is advantageous for long term operation, especially when motor 40 is an electromagnetic device. The stop may be less important for some other diaphragm driving devices, such as a piezoelectric transducer.

I claim:

1. A hearing aid comprising:

a main housing, insertable into the ear of a hearing aid user, the housing including a sound outlet wall that faces into the ear canal of the hearing aid user;

a receiver housing mounted within the main housing in spaced relation to the sound outlet wall;

diaphragm means, mounted within the receiver housing, defining first and second acoustic chambers in the receiver housing;

an electromagnetic motor, mounted in the receiver housing, mechanically connected to the diaphragm to move the diaphragm, at frequencies within a given audio range, in accordance with an electrical signal applied to the motor;

first and second outlet ports, through the receiver housing, one connected each chamber;

and first and second elongated sound transmission tubes, one for each outlet port, each tube connecting its outlet port through the sound outlet wall of the main housing into the user's ear canal independently of the other tube.

2. A hearing aid according to claim 1 in which the motor is mounted within the second acoustic chamber and the hearing aid further comprises contaminant stop means, between the motor and the end of the second sound transmission tube connecting through the sound outlet wall of the main housing, precluding access of contaminants from the user's ear canal to the motor without substantial modification of the sound properties of the second chamber and second tube.

3. A hearing aid according to claim 2 in which the contaminant stop means is positioned within the receiver housing between the motor and the second outlet port.

4. A hearing aid according to claim 3 in which the contaminant stop comprises a mesh screen.

5. A hearing aid according to claim 3 in which the contaminant stop comprises a series of baffles.

6. A hearing aid according to claim 3 in which the contaminant stop is a thin, flexible, substantially audio-transparent film.

7. A hearing aid according to claim 1 in which:

the first chamber and first tube have a first resonance frequency near the upper end of the audio range; and the second chamber and second tube have a second resonance frequency in the upper part of the audio range but appreciably below the first resonance frequency, so that the output of the hearing aid has a high band pass characteristic having upper and lower limits determined by the first and second resonance frequencies, respectively.

8. A hearing aid according to claim 7 in which:

the overall audio range is approximately 100 Hz to 10 kHz;

the first resonance frequency is in the range of 5 to 7 kHz; and the second resonance frequency is in the range of 2.5 to 3.5 kHz.

9. A hearing aid according to claim 7 in which the motor is mounted within the second acoustic chamber and the hearing aid further comprises contaminant stop means, between the motor and the end of the second sound transmission tube connecting through the sound outlet wall of the main housing, precluding access of contaminants from the user's ear canal to the motor without substantial modification of the sound properties of the second chamber and second tube.

10. A hearing aid according to claim 9 in which:

the overall audio range is approximately 100 Hz to 10 kHz;

the first resonance frequency is in the range of 5 to 7 kHz; and the second resonance frequency is in the range of 2.5 to 3.5 kHz.

11. A hearing aid according to claim 9 in which the contaminant stop means is positioned within the receiver housing between the motor and the second outlet port.

12. A hearing aid according to claim 11 in which the contaminant stop comprises a mesh screen.

13. A hearing aid according to claim 11 in which the contaminant stop comprises a series of baffles.

14. A hearing aid according to claim 11 in which the contaminant stop is a thin, flexible, substantially audio-transparent film.

* * * * *

UNITED STATES PATENT AND TRADEMARK OFFICE

CERTIFICATE OF CORRECTION

PATENT NO. : 5,068,901
DATED : November 26, 1991
INVENTOR(S) : Elmer V. Carlson

It is certified that error appears in the above-indentified patent and that said Letters Patent is hereby corrected as shown below:

Column 2, lines 26 and 27, cancel "a receiver transducer for";

Column 2, line 28, before "hearing" cancel "the' and substitute --a--.

Column 2, line 29, cancel "receiver transducer comprises a" and substitute--housing includes a second outlet wall that faces into the user's ear canal. A--.

Column 2, line 29, after "housing" insert --is--.

Column 2, line 31, cancel "a" and substitute --the--;

Column 2, lines 31 and 32, after "wall" insert a period and cancel the remainder of the line through "hearing aid user."

Column 2, after line 61 insert the following:

Fig. 1 is a block diagram illustrating a hearing aid 10 of the kind to which the present invention is applicable. The hearing aid 10 includes a sensor 11, usually called a microphone, on which sound waves 12 (speech, music, etc.) impinges. The output of microphone 11 is applied to an amplifier 13 that in turn drives a transducer 14, sometimes referred to a receiver. The output of of transducer 14 is applied to the user's ear canal 15 as an amplified or modified sound wave 16, through a sound transmission tube 17. In a modern hearing aid, microphone 11, amplifier 13, and receiver 14 are usually

UNITED STATES PATENT AND TRADEMARK OFFICE

CERTIFICATE OF CORRECTION

PATENT NO. : 5,068,901
DATED : November 26, 1991
INVENTOR(S) : Elmer V. Carlson

It is certified that error appears in the above-indentified patent and that said Letters Patent is hereby corrected as shown below:

incorporated in one main housing that fits into the ear of the user--.

Signed and Sealed this

Eleventh Day of January, 1994

*Attest:*

*Attesting Officer*

BRUCE LEHMAN

*Commissioner of Patents and Trademarks*